United States Patent [19]

Santiago

[11] Patent Number: 4,577,438

[45] Date of Patent: Mar. 25, 1986

[54] SECURITY WINDOW

[76] Inventor: Antonio O. Santiago, 6865 Michigan Ave., Detroit, Mich. 48210

[21] Appl. No.: 639,729

[22] Filed: Aug. 13, 1984

[51] Int. Cl.[4] ..... E06B 3/68

[52] U.S. Cl. ..... 49/57; 49/464

[58] Field of Search ..... 49/57, 50, 464

[56] References Cited

U.S. PATENT DOCUMENTS

| | | | |
|---|---|---|---|
| 3,160,927 | 12/1964 | Busillo | 49/57 |
| 3,325,237 | 6/1967 | Dirk et al. | 49/464 X |
| 3,381,416 | 5/1968 | DeTorres et al. | 49/464 |
| 3,745,704 | 7/1973 | Covington | 49/57 |

*Primary Examiner*—Kenneth Downey

*Attorney, Agent, or Firm*—Barnes, Kisselle, Raisch, Choate, Whittemore & Hulbert

[57] ABSTRACT

A security unit for a window opening in a building comprising an upper security panel in an upper portion of the window opening, and a lower security panel in the lower portion of the window opening. The lower panel is supported for sliding movement from its installed position in which its lower edge is received in a channel to an upper position to which the panel is withdrawn from the channel and may be removed so that the occupant may get out in an emergency. The lower panel is locked in the installed position by means comprising a pair of pins mounted on a track carried by the upper panel. The pins extend downward and terminate just above the upper edge of the lower panel to prevent it from moving upward away from its installed position far enough to withdraw from the channel. A pair of deep holes in the upper edge of the lower panel are capable of receiving the pins so that when the pins are aligned with the deep holes, the panel may be moved upwardly from the installed position far enough to clear the channel because the pins will enter the holes. There are also a plurality of relatively shallow holes along the upper edge of the lower panel which, however, are of insufficient depth to permit the panel to be raised far enough to clear the channel so that the panel cannot be unlocked and removed when the pins are aligned with the shallow holes. The relatively deep and relatively shallow holes are substantially indistinguishable to the touch so that it would be practically impossible for an intruder to discover the right combination of holes to open the unit. Once the lower panel has been removed, the upper panel may also be removed.

7 Claims, 5 Drawing Figures

SECURITY WINDOW

BACKGROUND AND SUMMARY OF THE INVENTION

A security window should provide a high degree of security but should also be capable of being easily removed or opened for emergency escape by the occupant.

In the specific embodiment of the invention about to be described, a security panel is supported in a window opening for sliding movement from an installed position in which the lower edge of the panel is received in a channel to an upper position in which the panel is withdrawn from the channel and may be removed or opened. The panel is locked in the installed position by means comprising a pair of pins mounted on a track disposed above the panel. The pins extend downward and terminate in opposed relation to the upper edge of the panel to prevent the panel from moving away from its installed position. There are a pair of spaced, relatively deep holes in the upper edge of the panel which are capable of receiving the pins. When the pins are aligned with the holes, the panel may be moved upwardly from the installed position because the pins will enter the holes and not interfere with such movement. When thus moved to the upper position, the panel may be removed or opened.

There are a plurality of relatively shallow holes along the upper edge of the panel which, however, are of insufficient depth to permit the panel to be moved far enough to clear the channel, so that the panel cannot be unlocked when the pins are aligned with the shallow holes. The relatively deep and relatively shallow holes are substantially indistinguishable to the touch at the surface of the upper edge so that it would be practically impossible for an intruder to discover the "right combination", that is, the pair of deep holes with which to align the pins, in order to unlock the panel.

These and other objects of the invention will become more apparent as the description proceeds, especially when considered with the accompanying drawings.

DETAILED DESCRIPTION

Figure 1:
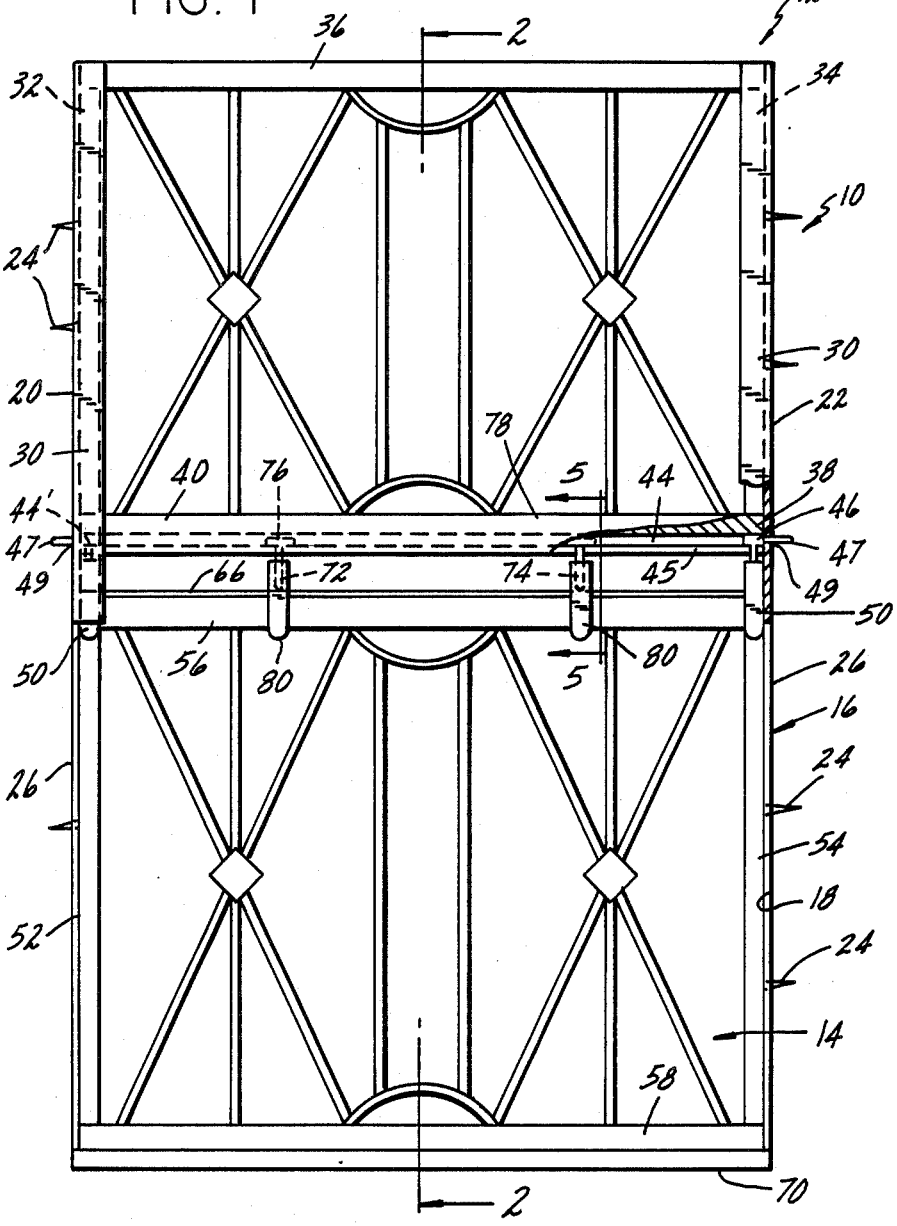
FIG. 1 is an inside elevational view, with parts broken away and in section, of a security unit constructed in accordance with my invention.

Referring now more particularly to the drawings, the security unit is generally designated 10 and comprises an upper security window or panel 12, a lower security window or panel 14 and a frame 16 for mounting the unit in a rectangular window opening 18.

The frame 16 comprises a pair of vertical channels 20 and 22 which are mirror images of each other. One of the channels is secured to one side of the window opening by fasteners 24 and the other secured to the other side of the window opening likewise by fasteners 24.

The channels are parallel and open inwardly toward one another. The web or base 26 and the outer flange 28 of each channel extend the full length of the window opening, but the inner flange 30 extends from the top of the window opening down only a little more than half way and then terminates.

The upper security panel 12 is an open frame of rectangular form composed of the laterally spaced vertical side bars 32 and 34 and the top and bottom bars 36 and 38 joined end to end. The space within the top, bottom and side bars of the upper security panel is covered by an open gridwork of security bars.

The upper security panel may be installed in the frame when the lower security panel is not in place, by inserting the upper edge into the channels 20 and 22 from beneath the lower edge of the inner channel flange 30 and then raising the upper security panel to the position shown in FIG. 1 in the upper portion of the window opening.

A pair of strips 40 and 41 are secured to the inner and outer faces of the bottom frame bar 38 of the upper security panel. Strips 40 and 41 extend downwardly beneath the bottom frame bar and terminate in inturned flanges 43 to define a hollow space or track 44 which extends the full width of the upper window unit and is open at both ends. The flanges 43 at the bottom of the strips terminate short of one another to define a slot 45 opening into the track and extending for the full length of the track. A pair of heads 44' and 46, which are wider than slot 45, slide in the track 44 near the ends thereof, each having a locking pin 47 pointed laterally outwardly. When the heads 44' and 46 are slid to their outer positions, the pins 47 are adapted to enter holes 49 in the base 26 of the channels 20 and 22 to lock the upper security panel in the installed position shown in FIG. 1. Each head has a narrow extension which extends downward through the slot 45 and terminates in a handle 50 which may be manipulated by the occupant to move the heads lengthwise in the track to either extend the pins 47 into the channel holes 49 to lock the security panel in installed position or to withdraw the pins from those holes to release the upper security panel so that it may be removed from the window opening.

The lower security panel 14 is an open frame of rectangular form composed of the laterally spaced vertical side bars 52 and 54 and the top and bottom bars 56 and 58 joined to one another end to end. The space within the top, bottom and side bars of the lower security panel is covered by an open gridwork of security bars.

Figure 2:
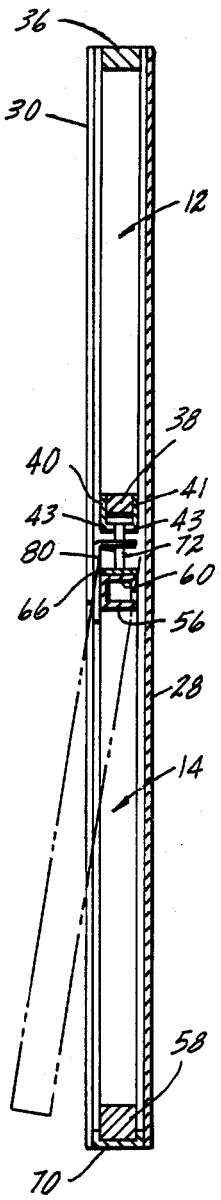
FIG. 2 is a sectional view taken along the line 2—2 in Fig. 1.
Figure 3:
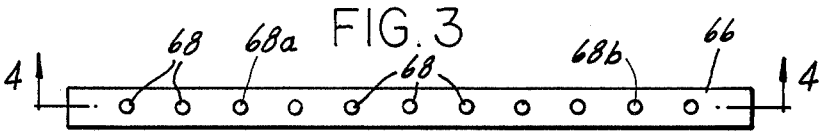
FIG. 3 is a plan view of the top edge of the lower security window or panel.
Figure 4:
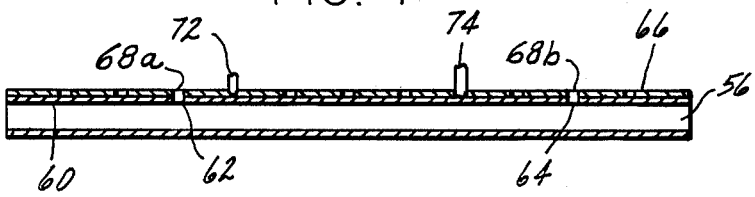
FIG. 4 is a sectional view taken along the line 4—4 in Fig. 3.

The top bar 56 of the lower security panel 14 is a hollow member of rectangular cross section. The upper wall 60 of the hollow frame member has a pair of holes 62 and 64 spaced from one another lengthwise of the top bar. An elongated plate or strip 66 is secured to the upper wall 60 of the top bar 56 and extends for the full length thereof. This plate or strip 66 has a row of holes 68 which are equally spaced from one another along the length of the strip. All of the holes 68 are of the same diameter as the two holes 62 and 64 in the upper wall 60 and two of the holes 68 i.e., **68*a* and 68*b*, in the plate 66 are aligned and in exact register with the two holes 62 and 64 in the top wall 60. FIGS. 1 and 2 show the lower security panel 14 installed in the window opening beneath the upper security panel 12, with its bottom frame bar 58 received in a channel 70 along the bottom of the window opening and its top frame bar 56 disposed above the lower edge of the channel flange 30. Hence the lower security panel cannot be removed from its installed position without first being raised far enough to clear the channel 70**.

The lower security panel is prevented from being raised far enough to clear the channel 70 by a pair of pins 72 and 74 which have heads 76 and 78 slidably disposed in the track 44. The heads 76 and 78 are wider than the slot 45.

The pins extend downward through slot 45 and their lower ends terminate in a position spaced only very slightly above the strip 66 on the top bar 58 of the lower security panel 14. A handle 80 secured to each pin is provided to enable the occupant to move the pins along the length of the track.

The pins 72 and 74 are of the same diameter as the holes 62, 64 and 68, and when the pins are aligned with the holes 68*a* and 68*b* in plate 66 and the registering holes 62 and 64 in the upper wall of the top bar 56, the lower security panel may be moved from its installed position upwardly far enough to withdraw its lower edge from the channel 70, because the pins will enter the holes and not interfere with such movement.

The security unit is installed by first installing the upper security panel 10 in the manner previously described, that is, by inserting the upper edge of the upper security panel 12 into the channels 20 and 22 from beneath the lower edge of the inner flange 30 and then raising the upper security panel to the position shown in FIG. 1 in the upper portion of the window opening. The handles 50 are manipulated to move the locking pins 47 laterally outwardly until they enter the holes 49 in the channels 20 and 22 to lock the upper security panel in the upper portion of the window opening.

Thereafter, the lower security panel 14 is installed by inserting its upper edge at an angle into the channels 20 and 22 from beneath the lower edge of the inner channel flange 30. Initially, however, the pins 72 and 74 are manipulated by their handles 80 to positions in which they are aligned with the holes 68*a* and 68*b* in plate 66 and the registering holes 62 and 64 in the upper wall of the top bar 56 so that the lower security panel may be raised to approximately the position shown in dotted lines shown in FIG. 2, the pins 72 and 74 entering the aligned holes 68*a*, 62 and 68*b*, 64 so as not to interfere with such movement. The lower security panel is then swung into the plane of the window opening and allowed to descend until its bottom bar 58 drops into the channel 70. The pins 72 and 74 are then moved away from their positions of alignment with holes 68*a* and 68*b*, their lower ends then being disposed in positions only slightly above the plate 66 to prevent the lower security panel from being raised sufficiently to withdraw its bottom bar 58 out of channel 70. Accordingly, the lower security panel 14 is locked in its installed position and cannot be removed. The upper panel 12 cannot be removed as long as the lower panel 14 is in place. There is slight clearance above the heads of the pins 72 and 74 in track 44, permitting slight vertical movement of the pins, but not enough to permit sufficient upward movement of the lower security panel to become disengaged from the track.

The remaining holes 68 in the plate 66, other than holes 68*a* and 68*b*, are shallow holes (compared to holes 68*a* and 68*b* which because they align with holes 62 and 64 may be considered as deep holes) because they do not line up with holes in the upper wall 60 of the top frame bar 56 of the lower security panel and thus even if the pins were aligned with such remaining holes 68 the panel could not be raised far enough to clear the flanges of channel 70 for removal.

Figure 5:
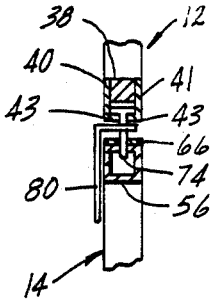
FIG. 5 is a fragmentary sectional view taken on the line 5—5 in FIG. 1, but showing the lower security panel raised to a position above its installed position.

The security unit provides a high degree of protection to the occupant and yet the occupant can, in an emergency, remove the security unit to escape from the building by simply lining up the pins 72 and 74 with the holes 68*a* and 68*b* so that the lower security panel may be raised to the FIG. 5 position, clearing the channel 70 and permitting the lower security panel 14 to be swung out to the dotted line position of FIG. 2, then lowered to disengage the pins 72 and 74 and removed. The upper security panel 12 can then be removed, if desired (but only after the lower panel 14 is removed), by withdrawing pins 47 from holes 49. On the other hand, it would be practically impossible for an intruder to discover the "right combination", that is the position of the pins 72 and 74 which align with the holes 68*a* and 68*b*, to remove the lower security panel. The remaining holes 68 along the top of the lower security panel, that is those holes other than holes 68*a* and 68*b*, are indistinguishable to the touch from holes 68*a* and 68*b*. Such additional holes are provided for the sole purpose of disception so that an intruder cannot remove the security panels.

I claim:

1. A security unit for a window opening in a building comprising a security panel, means for supporting said panel in said window opening for sliding movement from an installed position in which one edge of said panel is received in a channel to a second position in which said panel is withdrawn from said channel and may be removed or opened, and selectively operable means for either locking said panel in installed position by preventing sliding movement thereof to said second position or for unlocking said panel by permitting such sliding movement comprising means providing a track adjacent to the opposite edge of said panel, a plurality of pins independently slidably mounted on said track and extending toward and terminating in opposed relation to said opposite edge of said panel in the installed position thereof to prevent movement of said panel from said installed to said second position, means along said opposite edge of said panel providing a plurality of spaced, relatively deep openings capable of receiving said respective pins so that when the pins are aligned with said openings said panel may be moved from said installed to said second position because said pins will enter said openings and not interfere with such movement, whereby said panel may be removed or opened, and opening means along said opposite edge adapted to receive said pins but of insufficient depth to permit said panel to be moved far enough toward said second position to clear said channel, whereby the panel remains locked in installed position.

2. A security unit for a window opening in a building comprising a security panel, means for supporting said panel in said window opening for sliding movement from an installed position in which one edge of said panel is received in a channel to a second position in which said panel is withdrawn from said channel and may be removed or opened, and selectively operable means for either locking said panel in installed position by preventing sliding movement thereof to said second position or for unlocking said panel by permitting such sliding movement comprising means providing a track adjacent to the opposite edge of said panel, a plurality of pins independently slidably mounted on said track and extending toward and terminating in opposed relation to said opposite edge of said panel in the installed position thereof to prevent movement of said panel from said installed to said second position, means along said opposite edge of said panel providing a plurality of spaced, relatively deep openings capable of receiving said respective pins so that when the pins are aligned with said openings said panel may be moved from said installed to said second position because said pins will enter said openings and not interfere with such movement, whereby said panel may be removed or opened, and means along said opposite edge providing a plurality of spaced, relatively shallow openings adapted to receive said respective pins when said pins are aligned therewith but of insufficient depth to permit said panel to be moved far enough toward said second position to clear said channel, whereby the panel remains locked in installed position.

3. A security unit as defined in claim 2 wherein said relatively deep and relatively shallow openings are substantially indistinguishable to the touch at the surface of said opposite edge through which said openings extend.

4. A security unit for a window opening in a building comprising an upper security panel, means for locking said upper security panel in an upper portion of said window opening, a lower security panel, means for supporting said lower security panel in a lower portion of said window opening in spaced relation beneath said upper security panel for sliding movement from an installed position in which the lower edge of said lower panel is received in a channel to an upper position in which said lower panel is withdrawn from said channel and may be removed or opened, and selectively operable means for either locking said lower panel in installed position by preventing sliding movement thereof to said upper position or for unlocking said lower panel by permitting such sliding movement comprising means providing a track along the lower edge of said upper panel, a plurality of pins independently slidably mounted on said track and extending toward and terminating in opposed relation to the upper edge of said lower panel in the installed position thereof to prevent movement of said lower panel from said installed to said upper position, means along said upper edge of said lower panel providing a plurality of spaced, relatively deep openings capable of receiving said respective pins so that when the pins are aligned with said openings said lower panel may be moved from said installed to said upper position because said pins will enter said openings and not interfere with such movement, whereby said lower panel may be removed or opened, and means along said upper edge of said lower panel providing a plurality of spaced, relatively shallow openings adapted to receive said respective pins when said pins are aligned therewith but of insufficient depth to permit said lower panel to be moved far enough toward said upper position to clear said channel, whereby the lower panel remains locked in installed position.

5. A security unit as defined in claim 4, wherein said relatively deep and relatively shallow openings are substantially indistinguishable to the touch at the surface of said upper edge of said lower panel through which said openings extend.

6. A security unit as defined in claim 4, wherein said locking means for said upper panel is releasable, and support means are provided to support said upper panel in said upper position of said window opening for sliding movement to a lower position in which said upper panel may be removed or opened when said locking means for said upper panel is released, said upper panel being prevented from sliding to its lower position by said lower panel when said lower panel is in its installed position.

7. A security unit as defined in claim 6, wherein said locking means for said upper security panel comprises pins releasable engageable with co-acting detent means on said support means for locking said upper security panel in said upper portion of said window opening.

* * * * *